US008327747B2

(12) United States Patent
Riggs et al.

(10) Patent No.: US 8,327,747 B2
(45) **Date of Patent: *Dec. 11, 2012**

(54) PROJECTILE PROPULSION SYSTEM

(75) Inventors: Jeffrey L. Riggs, Pittsboro, NC (US); Vladislav Oleynik, Pittsboro, NC (US); Valery Borovikov, Saint Petersburg (RU); Gennadiy Albul, Pittsboro, NC (US)

(73) Assignee: Causwave, Inc., Pittsboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/449,859

(22) Filed: Apr. 18, 2012

(65) Prior Publication Data

US 2012/0204709 A1 Aug. 16, 2012

Related U.S. Application Data

(63) Continuation of application No. 12/476,555, filed on Jun. 2, 2009, now Pat. No. 8,181,561.

(60) Provisional application No. 61/130,547, filed on Jun. 2, 2008.

(51) Int. Cl.
*F41F 3/04* (2006.01)

(52) U.S. Cl. ..... 89/1.817; 89/1.8; 89/1.816; 102/370

(58) Field of Classification Search ..... 89/1.817, 89/1.34, 1, 4, 130–139; 102/370, 381
See application file for complete search history.

(56) References Cited

U.S. PATENT DOCUMENTS 1,985,184 A * 12/1934 Methlin ..... 114/238
3,167,061 A * 1/1965 Murray ..... 124/60
3,397,638 A * 8/1968 Gould ..... 102/377
3,561,362 A * 2/1971 Black et al. ..... 102/374
3,754,726 A * 8/1973 Rusbach ..... 244/3.28
4,038,115 A * 7/1977 Dehm ..... 149/19.8
4,373,420 A * 2/1983 Piesik ..... 89/1.812
4,389,938 A * 6/1983 Sigrist ..... 102/337
H0000684 H * 10/1989 Arszman et al. ..... 102/377
5,440,993 A * 8/1995 Osofsky ..... 102/374
5,579,636 A * 12/1996 Rosenfield ..... 60/251
5,652,405 A * 7/1997 Rakov ..... 89/7
5,909,000 A * 6/1999 Rakov ..... 89/7
6,142,055 A * 11/2000 Borgwarth et al. ..... 89/1.817
6,352,030 B1 * 3/2002 Doll et al. ..... 102/291
6,526,860 B2 * 3/2003 Facciano et al. ..... 89/1.801
6,854,409 B1 * 2/2005 Galliano ..... 114/238
6,979,021 B2 * 12/2005 Young et al. ..... 280/737
7,484,450 B2 * 2/2009 Hunn et al. ..... 89/1.818
7,845,282 B2 * 12/2010 Sheridan et al. ..... 102/473
7,954,412 B2 * 6/2011 Jansson ..... 89/1.817
2002/0189432 A1 * 12/2002 Facciano et al. ..... 89/1.801
2003/0089435 A1 * 5/2003 Sanderson et al. ..... 149/19.1
2006/0060692 A1 * 3/2006 Yehezkeli et al. ..... 244/3.21

(Continued)

*Primary Examiner* — Bret Hayes
*Assistant Examiner* — Joshua Freeman
(74) *Attorney, Agent, or Firm* — R. Brian Drozd; Nelson, Mullins, Riley & Scarborough LLP

(57) ABSTRACT

A projectile propulsion system includes a launch tube, multiphase material, and a pressure barrier member. The launch tube has an interior cavity, the multiphase material disposed therein. The launch tube also has an opening to receive the multiphase material. The pressure barrier member seals the opening while the multiphase material is disposed in the interior cavity of the launch tube so as to allow the launch tube to be pressurized. When the pressure barrier member is broken, a shock wave allows the contents of the interior cavity, such as a projectile, to be expelled from the tube with a high velocity and force.

12 Claims, 15 Drawing Sheets

U.S. PATENT DOCUMENTS

2007/0251615 A1* 11/2007 Amtower, II ..... 149/37
2010/0078004 A1* 4/2010 Oleynik et al. ..... 124/73
2010/0251694 A1* 10/2010 Hugus et al. ..... 60/253
2010/0282115 A1* 11/2010 Sheridan et al. ..... 102/491

* cited by examiner

PROJECTILE PROPULSION SYSTEM

CROSS-REFERENCE TO RELATED APPLICATION

This application claims priority from co-pending U.S. Non-Provisional patent application Ser. No. 12/476,555 filed on Jun. 2, 2009, which claims priority to U.S. Provisional Patent Application No. 61/130,547 and filed Jun. 2, 2008, the entirety of both applications are incorporated herein by reference.

BACKGROUND OF THE INVENTION

Currently, projectile systems require combustible fuels which burn or explode to propel an object. Such systems pollute the environment, use non-renewable resources, create dangerous explosions, and are expensive.

SUMMARY

In accordance with an aspect of the present invention, a projectile propulsion system includes a launch tube, multiphase material, and a pressure barrier member. The launch tube has an interior cavity, the multiphase material disposed therein. The launch tube also has an opening to receive the multiphase material. The pressure barrier member seals the opening while the multiphase material is disposed in the interior cavity of the launch tube so as to allow the launch tube to be pressurized.

In some embodiments, when the pressure barrier member is broken, a shock wave allows the contents of the interior cavity, such as a projectile, to be expelled from the tube with a high velocity and force.

In one embodiment, a method includes filling an interior cavity of a tube with a multiphase material. The tube may include sidewalls, a first end, a second end and an opening at the second end. A projectile is disposed into the interior cavity of the tube such that the projectile is surrounded by the multiphase material. The opening of the tube is sealed with a pressure barrier member (e.g., a cap) while the multi-phase material and projectile are disposed in the interior cavity of the tube. The sealed tube is pressurized with a gas while the tube is sealed and prior to launching the projectile. Prior to launching the projectile, the pressure barrier member is removed thereby allowing equalization of the pressure from the interior cavity with pressure on the exterior of the tube and also thereby resulting in a first shock wave and a second shock wave. The first shock wave emanates away from the projectile and the second shock wave travels down the tube and reflects from the first end of the tube so that the projectile is expelled out of the tube.

In another embodiment, a method of operation of a projectile propulsion system includes providing a projectile propulsion system including a tube. The tube includes an interior cavity and an opening. Multi-phase material is disposed in the interior cavity. A projectile is disposed into the interior cavity of the tube such that the projectile is surrounded by the multiphase material. The opening of the tube is sealed with a removable pressure barrier member while the multi-phase material and projectile are disposed in the interior cavity of the tube. The sealed tube is pressurized with a gas while the tube is sealed and prior to launching the projectile. Prior to launching the projectile and after pressuring the sealed tube, the removable pressure barrier member is removed to allow equalization of pressure from outside of the launch tube and the interior cavity of the launch tube so that when the removable pressure barrier member is removed, the projectile is launched from the tube.

According to another embodiment, a system of a multiphase projectile propulsion system includes: a tube comprising an interior cavity and an opening; multi-phase material disposed in the interior cavity of the tube; a projectile disposed into the interior cavity of the tube such that the projectile is surrounded by the multi-phase material; and a pressure barrier member configured to seal the opening while the multi-phase material and projectile are disposed in the interior cavity of the tube. The tube can be pressurized with a gas while the tube is sealed and prior to launching the projectile. Prior to launching the projectile and after pressuring the sealed tube, the removable pressure barrier member is configured to allow equalization of pressure from outside of the launch tube and the interior cavity of the launch tube when the removable pressure barrier member is removed, thereby launching the projectile.

Other aspects and features of the present invention, as defined solely by the claims, will become apparent to those ordinarily skilled in the art upon review of the following non-limited detailed description of the invention in conjunction with the accompanying figures.

DETAILED DESCRIPTION

Embodiments of the present invention are described below with reference to flowchart illustrations and/or block diagrams of method and apparatus (systems). It will be understood that each block of the flowchart illustrations and/or block diagrams, and/or combinations of blocks in the flowchart illustrations and/or block diagrams, can be controlled by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Figure 1:
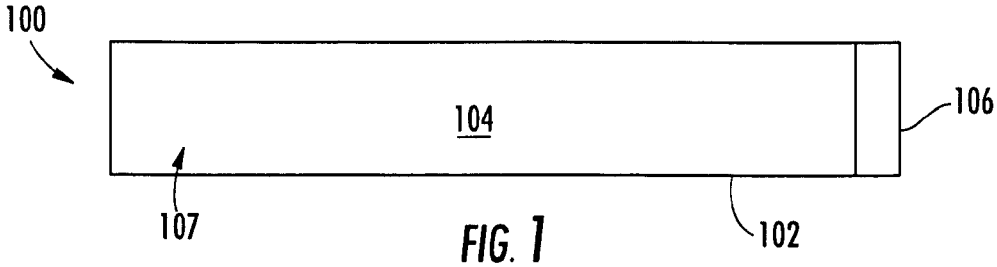
FIG. 1 is a projectile propulsion system in accordance with an embodiment of the present invention.

FIG. 1 is a projectile propulsion system 100 in accordance with an embodiment of the present invention. The projectile propulsion system 100 includes a launch tube 102, multiphase material (MPM) 104 and a pressure barrier member 106. The launch tube 102 may be any container which is capable of holding material (e.g. MPM 104) and capable of being pressurized. The launch tube 102 has an interior cavity 107 for receiving such material. The launch tube 102 may be of any shape or size. For example, the launch tube 102 may be a cylindrical shape, as shown in FIG. 1. The launch tube 102 may be of any size including a hand-held device or a large aerospace rocket. At least a portion of the launch tube 102 is initially hollow. Any type of materials that make up the body of the launch tube, including metals (e.g. steel, aluminum, etc.), plastic (e.g. PVC) and the like. In one embodiment, the launch tube 102 is a hollow pipe or a plastic tube. The launch tube has at least one opening 108 to receive MPM 104 and/or pressurized air/gas.

The MPM 104 may be any material having a mulitphase composite structure. An example of such MPM 104 includes any naturally occurring particles, such as sand. In one embodiment, MPM 104 may include any material which has a multiplicity of chemical elements bonded together such that when such bond is broken energy is released. The MPM 104 may have a porosity greater than 0 but less or equal to 1. At least a portion or all of the interior cavity 107 of the launch tube 102 is filled with MPM 104. In some embodiments, the MPM 104 may be particles that act as a propellant, such as particles which are flammable, explosive or have other properties of propellant. In some embodiments, the MPM 104 is a synthetic material.

The pressure barrier member 106 is a device which seals the launch tube 102 by covering the opening 108 of the launch tube 102. The pressure barrier member 106 may be made of any material, including plastic, rigid materials, elastic, or any other material. In one embodiment, the pressure barrier member 106 is a material which is allowed to be ripped or compromised in response to a predetermined trigger, such as heat, ignition, sharp object, and the like. In another embodiment, the pressure barrier member 106 may be a door or other apparatus which may be removable from the opening 108 of the launch tube 102. In another embodiment, the pressure barrier member 106 is a cap which fastens on the end of the launch tube. The pressure barrier member 106 is secured to the launch tube 102 via any manner, such as glue, fasteners, hinge, friction, cap, threads, or the like, to removably seal the launch tube 102. In one embodiment, multiple pressure barrier members (not shown) may be employed to cover multiple openings (not shown).

Figure 2:
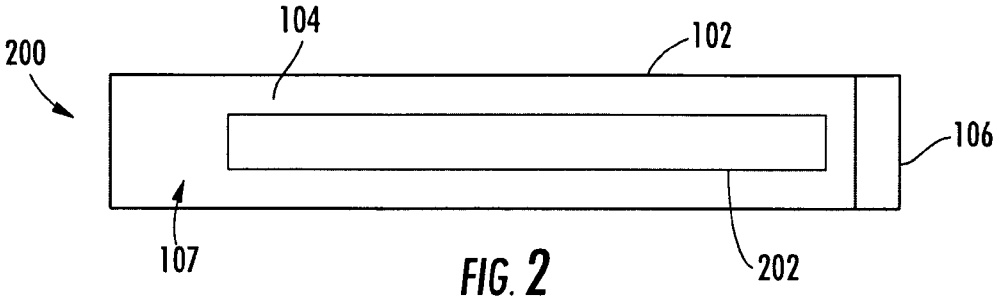
FIG. 2 is a projectile propulsion system in accordance with another embodiment of the present invention.

FIG. 2 is another projectile propulsion system 200 in accordance with another embodiment of the present invention. FIG. 2 illustrates the projectile propulsion system 100 of FIG. 1 with a projectile 202 inserted in the interior cavity 107 of the launch tube 102. At least a portion of the projectile 202 is surrounded by MPM 104. For example, as illustrated, the projectile 202 is completely surrounded by MPM 104.

Figure 3:
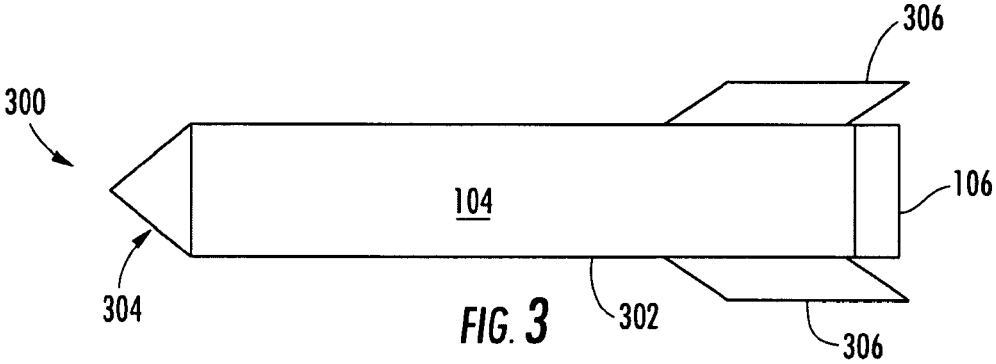
FIG. 3 is a projectile propulsion system in accordance with another embodiment of the present invention.

FIG. 3 is a projectile propulsion system 300 in accordance with another embodiment of the present invention. FIG. 3 illustrates the projectile propulsion system 100 of FIG. 1 with a launch tube 302 having at least one characteristic of a rocket. For example, as illustrated, the launch tube 302 has an aerodynamic shape (e.g. pointed front 304) and fins 306 to direct the launch tube. It should be noted that no projectile is located in the launch tube 302 through space.

Figure 4:
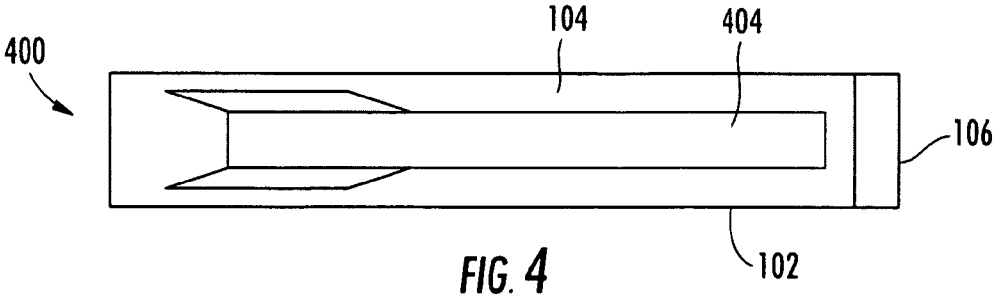
FIG. 4 is a projectile propulsion system in accordance with another embodiment of the present invention.

FIG. 4 is a multiphase projectile propulsion system 400 in accordance with another embodiment of the present invention. FIG. 2 illustrates the projectile propulsion system 100 of FIG. 1 with a projectile 404 inserted in the interior cavity 107 of the launch tube 102. The projectile 404 is another projectile propulsion system similar to the projectile propulsion system of FIG. 2. Both the interior cavity 102 of the projection propulsion system 400 and the interior cavity 406 of the embedded projectile propulsion system 404 include MPM 104.

Figure 5A:
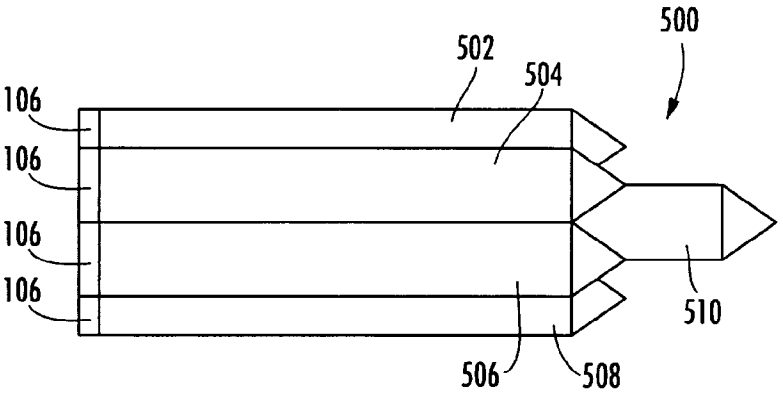
FIGS. 5A-B (collectively FIG. 5) is a multistage projectile propulsion system in accordance with another embodiment of the present invention.
Figure 5B:
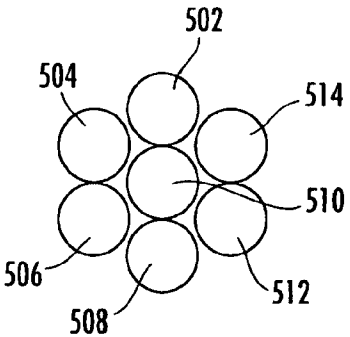

FIGS. 5A-B (collectively FIG. 5) is a multistage projectile propulsion system 500 in accordance with another embodiment of the present invention. FIG. 5A illustrates a plurality of active propulsion systems 502, 504, 506, 508, 510, 512, and 514, each similar to the propulsion system 300 of FIG. 3. Specifically, as illustrated in FIG. 5B, seven projectile propulsion systems 502, 504, 506, 508, 510, 512, and 514 are attached together to form a single multistage projectile propulsion system 500. Three of the projectile propulsion systems 502, 504, 506 of the multistage projectile propulsion system are paired together with three other projectile propulsion systems 508, 512, 514, respectively. The center projectile propulsion system 510 is not paired in the exemplary illustration.

Figure 6:
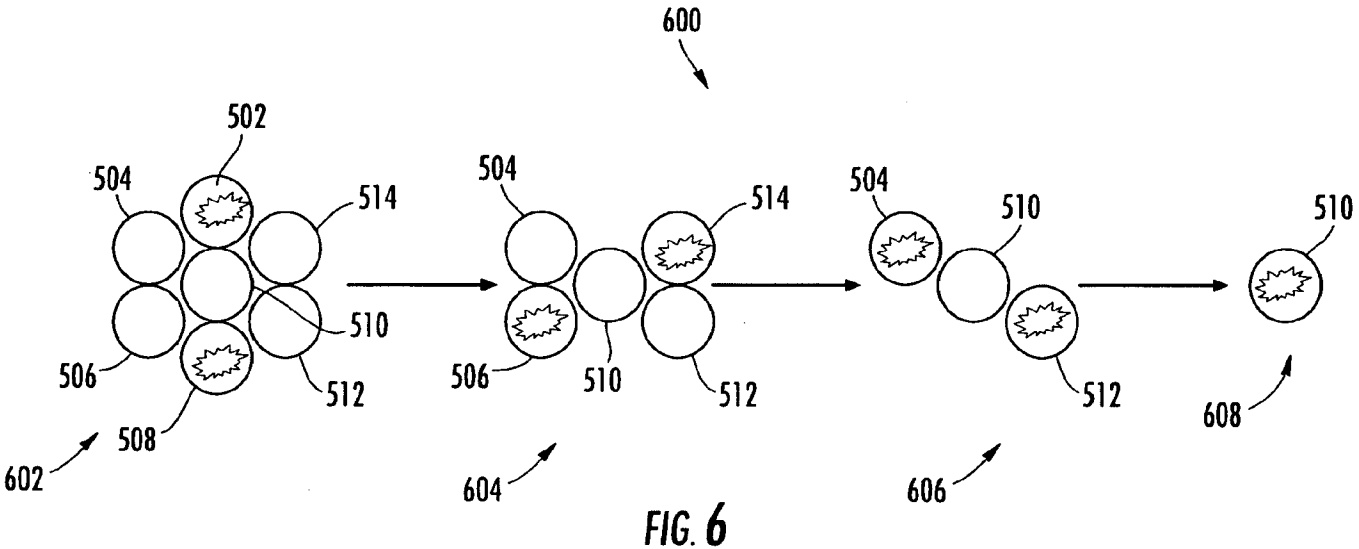
FIG. 6 illustrates a method of operation of the multistage projectile propulsion system of FIG. 5 in accordance with an embodiment of the present invention.

FIG. 6 illustrates a method 600 of operation of the multistage projectile propulsion system 500 of FIG. 5 in accordance with an embodiment of the present invention. In the first stage 602 of the multistage projectile propulsion system 600, the first pair of projectile propulsion systems 502, 508 is activated. After the first pair 502, 508 is activated, the second pair of projectile propulsion systems 506, 514 is activated in a second stage 604. Thereafter, for a third stage 606, the third pair 504, 512 of projectile propulsion systems is activated. For the last stage 608, the center projectile propulsion system 510 is activated. It should be understood that any of the above activations 602-608 of the projectile propulsion systems of the multistage projectile propulsion system 600 may be activated in different orders and/or simultaneously with any other stage(s) 602-608. Additionally, any number of stages may be included in the multistage projectile propulsion system.

Figure 7:
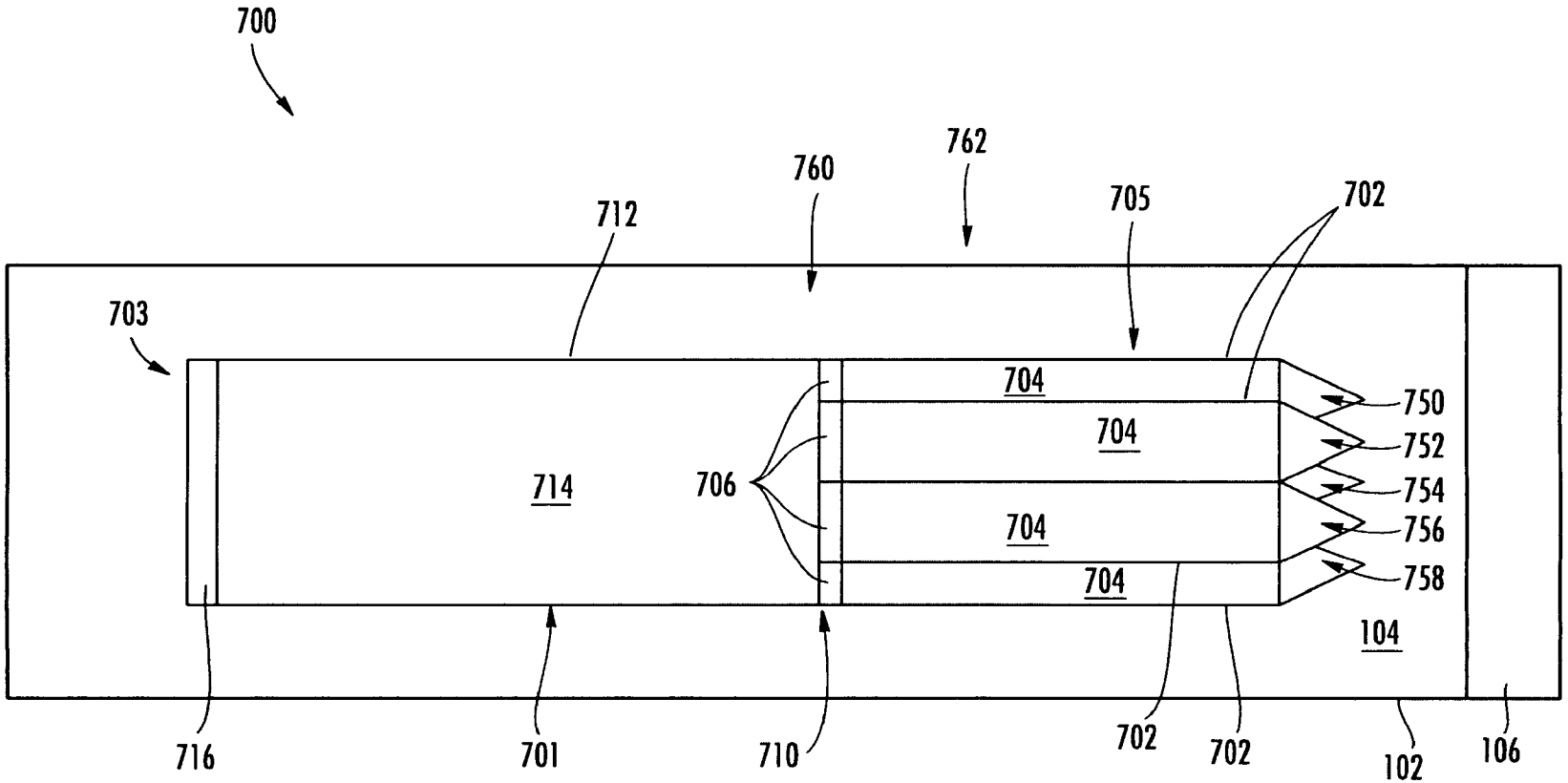
FIG. 7 is a multistage projectile propulsion system in accordance with another embodiment of the present invention.

FIG. 7 is another multistage projectile propulsion system 700 in accordance with another embodiment of the present invention. FIG. 7 includes a double multistage projectile propulsion system 703, which includes a thrust projectile propulsion system 701 attached to a multistage projectile propulsion system 705. The thrust projectile propulsion system 704 is similar to the projectile propulsion system 100 of FIG. 1 and includes a MPM 714, launch tube 712, a pressure barrier member 716, and an attachment means 710, such as adhesive, releasably fasteners, etc., to attach to the multistage projectile propulsion system 705. The multistage projectile propulsion system 705 is similar to the multistage projectile propulsion system 500 of FIG. 5 and each projectile propulsion system 750-758 of the multistage projectile propulsion system 705 includes MPM 704, launch tube 702, and a pressure barrier member 706. The double multistage projectile propulsion system 703 is located in an interior cavity 760 of a launching projectile propulsion system 762, which is similar to the projectile propulsion system of FIG. 1. The launching projectile propulsion system 762 includes MPM 104, launch tube 102, and a pressure barrier member 106. To launch the double multistage projectile propulsion system 703 of FIG. 7 the launching projectile propulsion system 762 is first activated. After the double multistage projectile propulsion system 703 is launched a predetermined time or distance from the launching projectile propulsion system 762, the thrust projectile propulsion system 701 is activated. After the thrust projectile propulsion system 701 is activated for a predetermined time, the multistage projectile propulsion system 705 is activated, similar to that described above with regard to FIG. 6. The description of how to operate or activate each projectile propulsion system 762, 701, 750-758 is described below with reference to FIG. 9.

Figure 8:
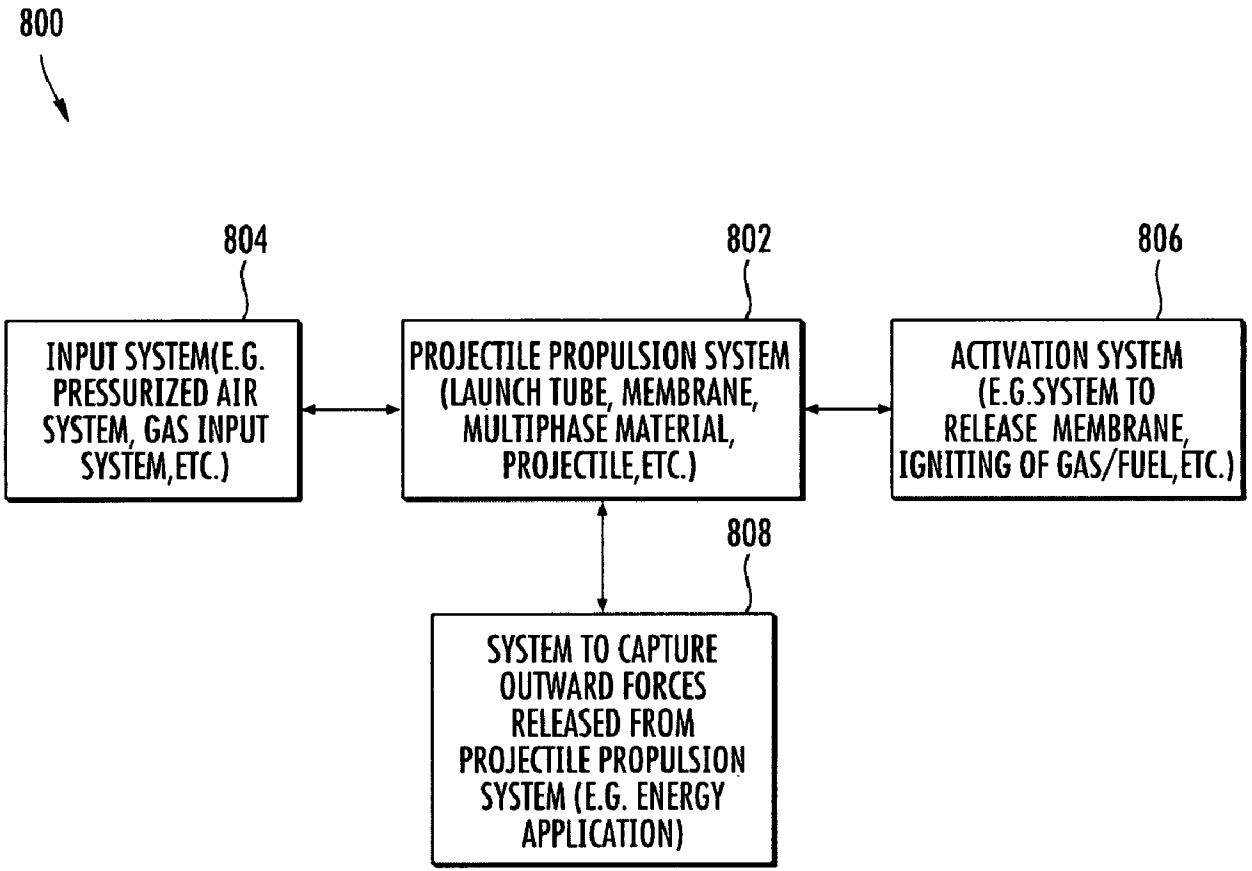
FIG. 8 is a block schematic diagram of an example of a system for projectile propulsion in accordance with an embodiment of the present invention.

FIG. 8 is a block schematic diagram of an example of a system 800 for projectile propulsion in accordance with an embodiment of the present invention. The system 800 includes at least one projectile propulsion system 802, as previously described with respect to FIGS. 1-7. Also, the system 800 may include one or more input systems 804, such as a system to pressurize the projectile propulsion system 802 with air, gas and the like. The input system 804 may be connected to any portion of the projectile propulsion system 802, including any opening or valve. Additionally, the system 800 may include an activation system 806, which releases the pressure barrier member to allow a sudden equalization of pressure between the interior cavity and the exterior of the projectile propulsion system 802. The system 800 may further include a system 808 to capture outward forces released from the projectile propulsion system 802. For example, the capture system 808 may capture MPM expelled from the interior cavity of the projectile propulsion system 802.

Figure 9:
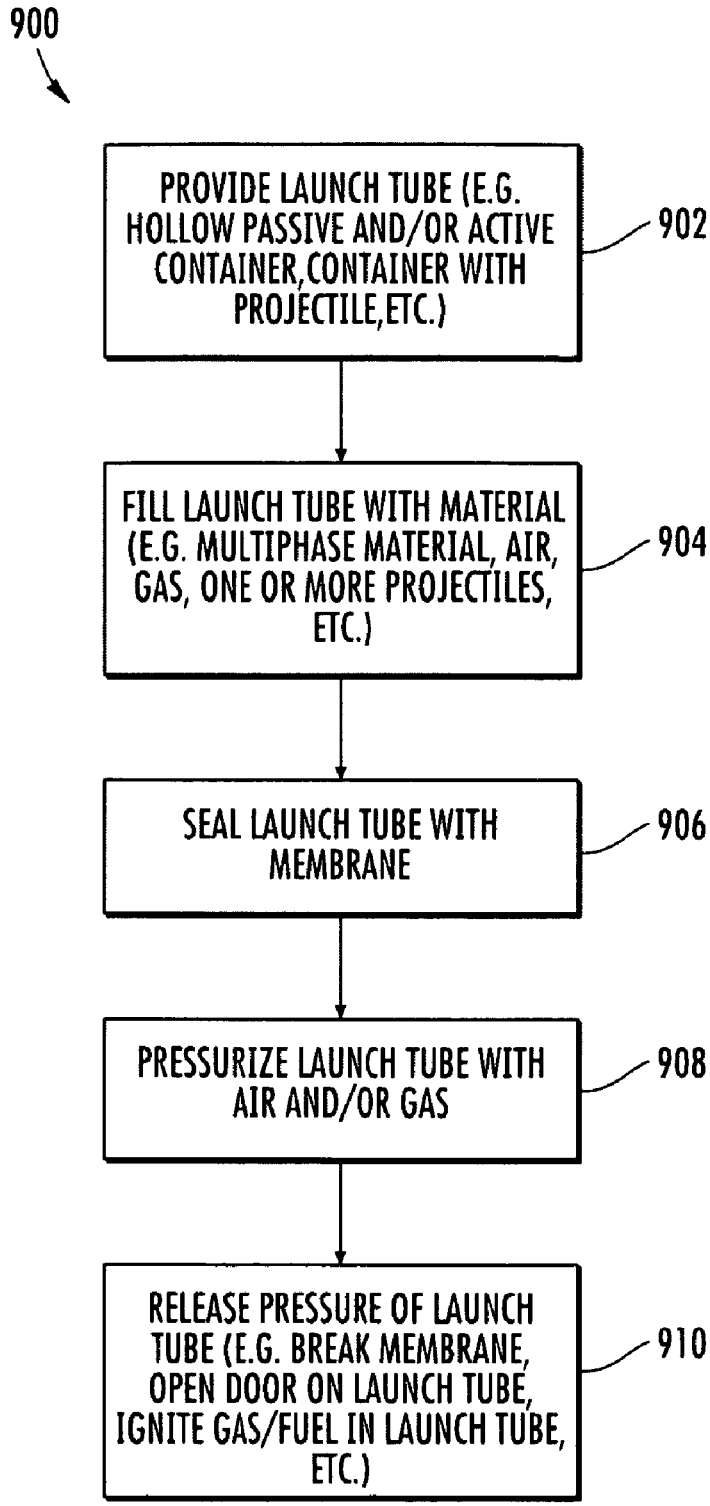
FIG. 9 is a method of operation of a projectile propulsion in accordance with an embodiment of the present invention.

FIG. 9 is a method 900 of operation of any projectile propulsion system in accordance with an embodiment of the present invention. In block 902, a launch tube is provided. As previously discussed, the launch tube may be a hollow container capable of receiving MPM and capable of being pressurized. In block 904, the launch tube is filled with material, such as MPM, projectiles, other projectile propulsion systems, or any other material and/or device. In block 906, the launch tube is sealed with a pressure barrier member (e.g., a cap) so as to form an airtight seal therein. In block 908, the launch tube is pressurized by adding air and/or gas to the launch tube to achieve a predetermined pressure in the cavity. In block 910, the pressure of the launch tube is released (or equalized with pressure from the exterior of the launch tube) by, for example, breaking the pressure barrier member or forcing the pressure barrier member to release, opening a door on the launch tube, igniting any gas/fuel in the launch tube, heating the launch tube and/or pressure barrier member, and any other way to allow the launch tube to release pressure. By equalizing the pressure of the exterior of the launch tube with the interior cavity of the launch tube, two shock waves are created. A first shock wave emanates away from the launch tube. A second shock wave travels into the interior cavity of the launch tube. In this regard, the second shock wave travels down the longitudinal length in the interior cavity of the launch tube (and in between the sidewalls of the launch tube and the projectile disposed in the launch tube), hits the back wall (e.g., the wall opposing the opening of the launch tube), and then travels back up the launch tube toward the opening of the launch tube allowing the projectile and at least some MPM therein to be expelled from the launch tube. Additionally, energy from the MPM may be released contributing to the shock wave.

Figure 10A:
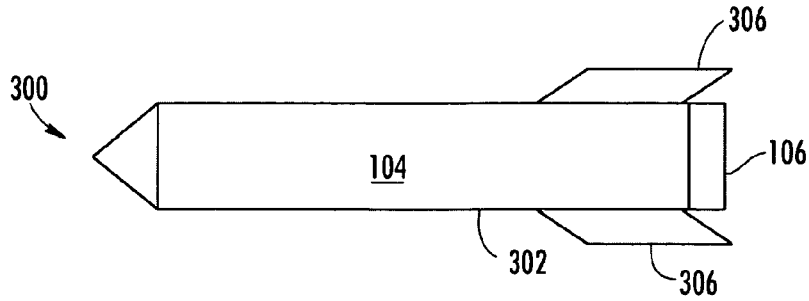
FIGS. 10A-B illustrates a method of operation of the projectile propulsion system of FIG. 3.
Figure 10B:
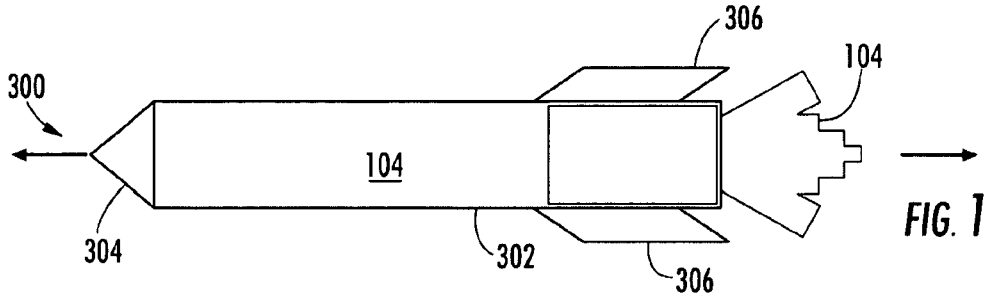

FIGS. 10A-B visually illustrates an exemplary method of operation of the projectile propulsion system 300 of FIG. 3. FIG. 10A illustrates the projectile propulsion system 300 of FIG. 3 after pressurization. FIG. 10B illustrates the projectile propulsion system 300 immediately after the pressure barrier member 106 is broken or removed, resulting in MPM 104 thrust in a first direction and the launch tube propelled in an opposite direction. As shown, the MPM 104 is released from the interior cavity of the launch tube 302.

Figure 11A:
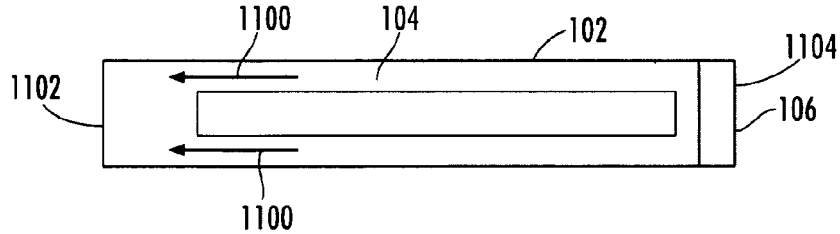
FIGS. 11A-C illustrates a method of operation of the projectile propulsion of FIG. 2.
Figure 11B:
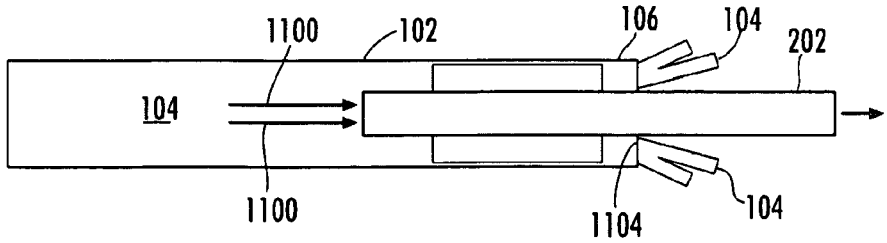
Figure 11C:
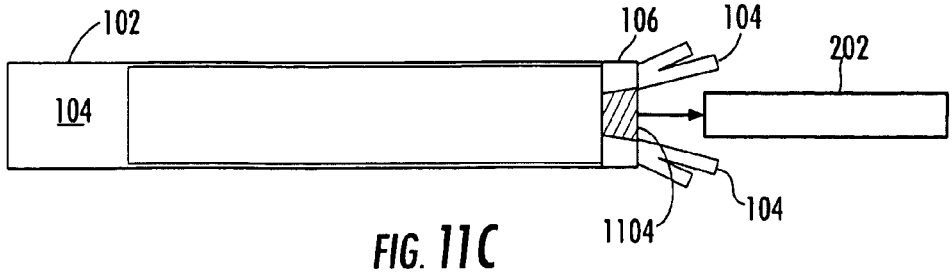

FIGS. 11A-C illustrates an exemplary method of operation of the projectile propulsion system 200 of FIG. 2. FIG. 11A illustrates the projectile propulsion system 200 of FIG. 2 when the pressure barrier member 106 of projectile propulsion system 200 is first broken or removed from the launch tube. As shown, a shock wave 1100 travels down the longitudinal length of the launch tube 102 toward the end 1102 (or back wall) of the launch tube 102. After the shock wave 1100 reaches the end 1102 of the launch tube 102, the shock wave 1100 travels back toward the opening 1104 of the launch tube 102 propelling the projectile 202 of the projectile propulsion system 200, as shown in FIG. 11B. MPM 104 is shown as being expelled out of the launch tube 102 along with the projectile 202. As illustrated in FIG. 11C, the projectile 202 is forced completely out of the launch tube 102 with a tremendous amount of force and velocity.

Figure 12:
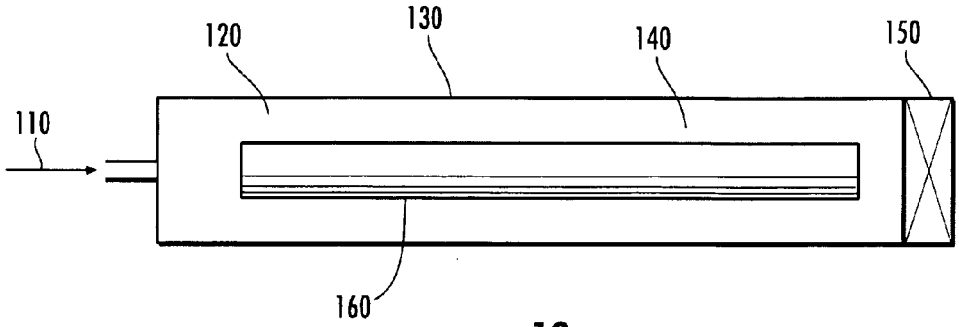
FIG. 12-36 illustrate a cross-sectional view of the projectile propulsion system according to various embodiments of the present invention.
Figure 13:
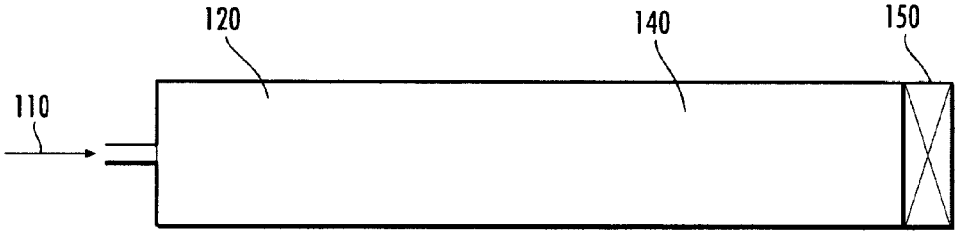
Figure 14:
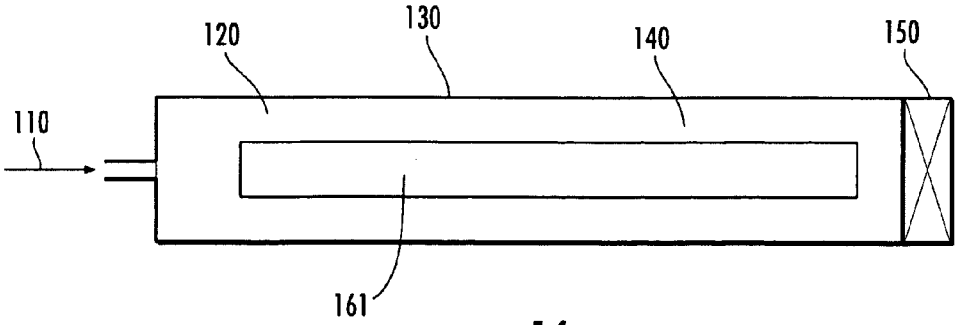
Figure 15:
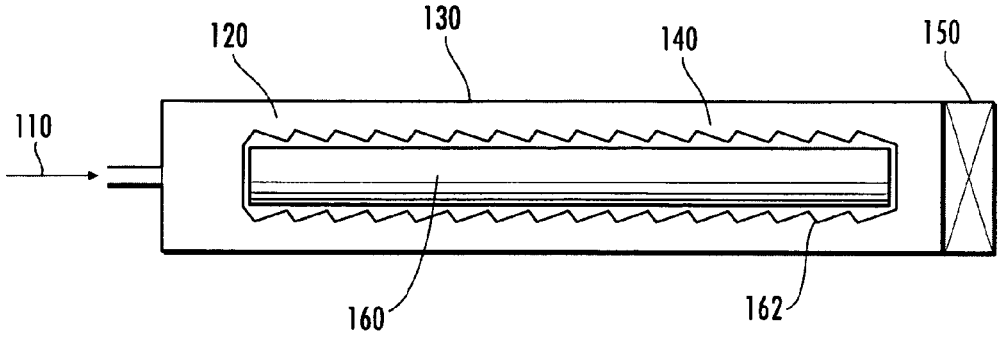
Figure 16:
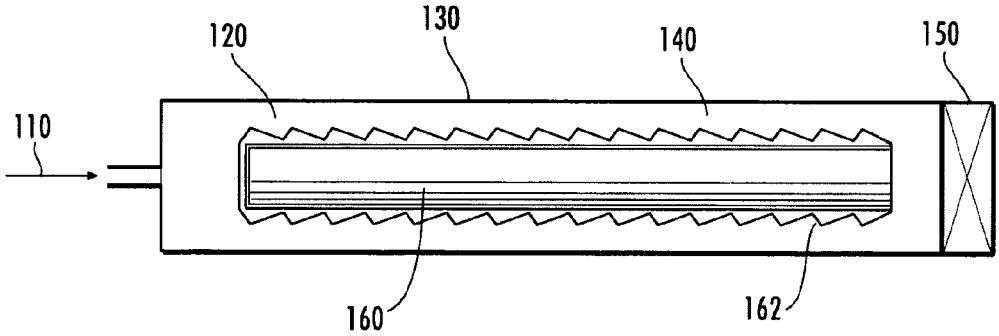
Figure 17:
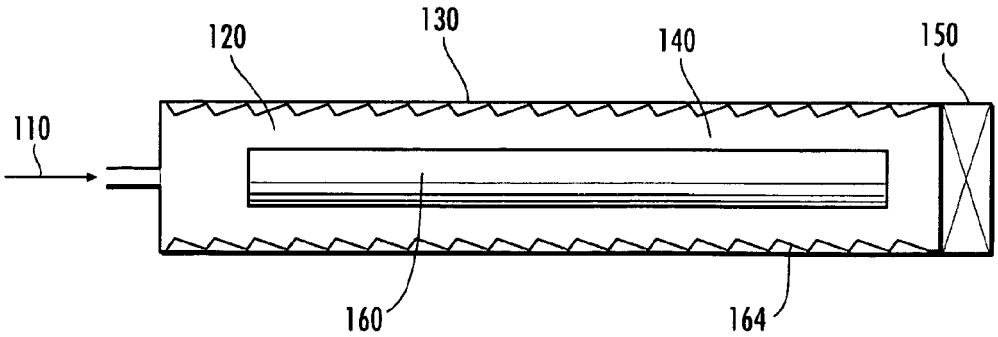
Figure 18:
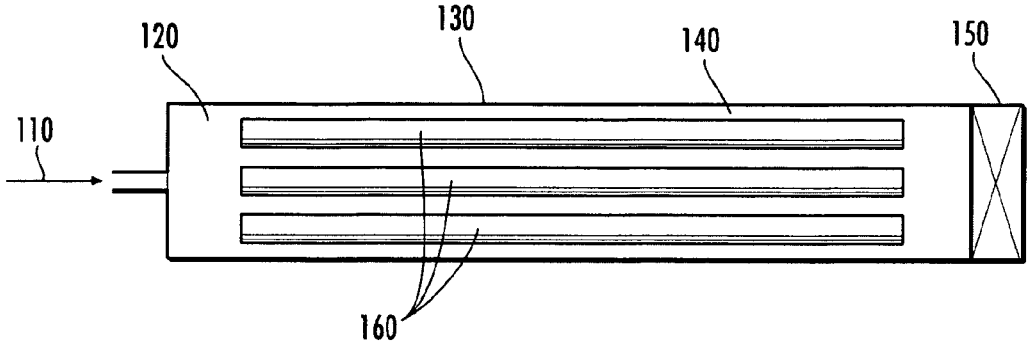
Figure 19:
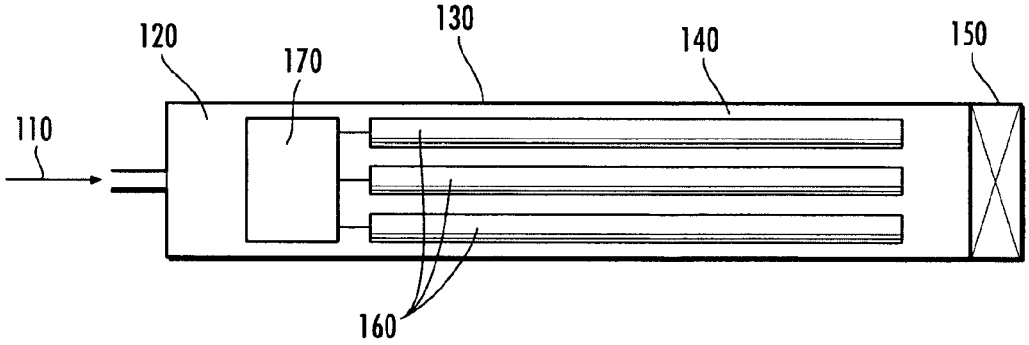
Figure 20:
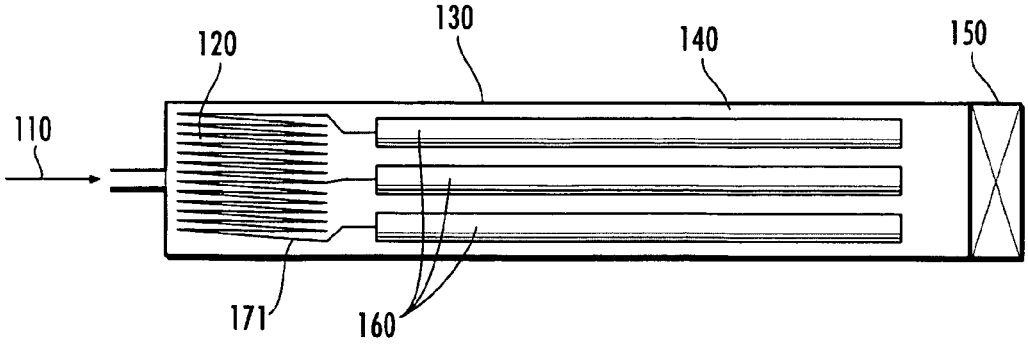
Figure 21:
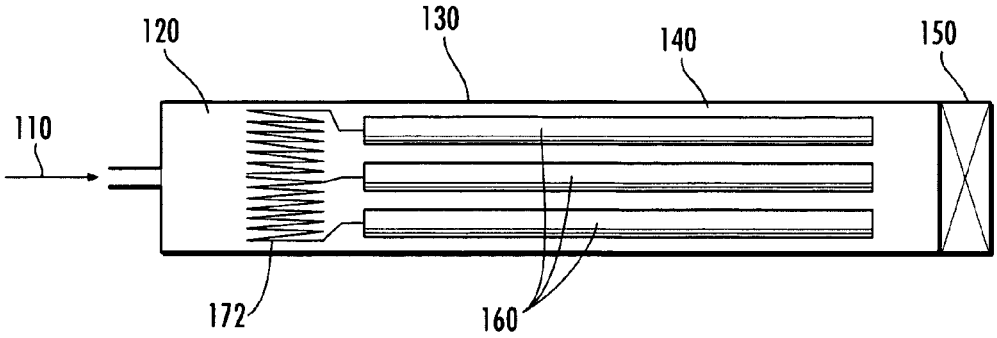
Figure 22:
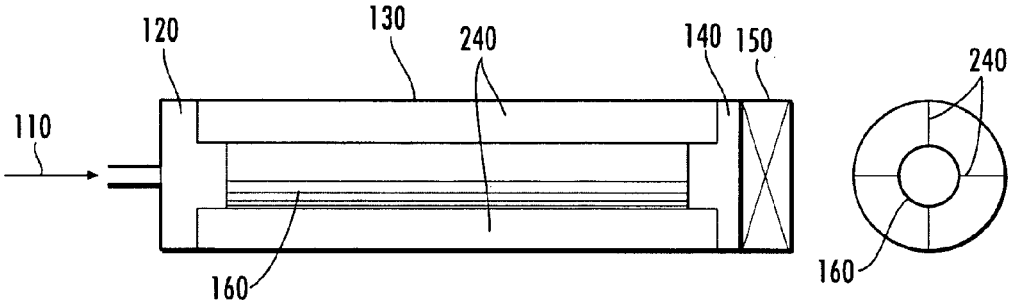
Figure 23:
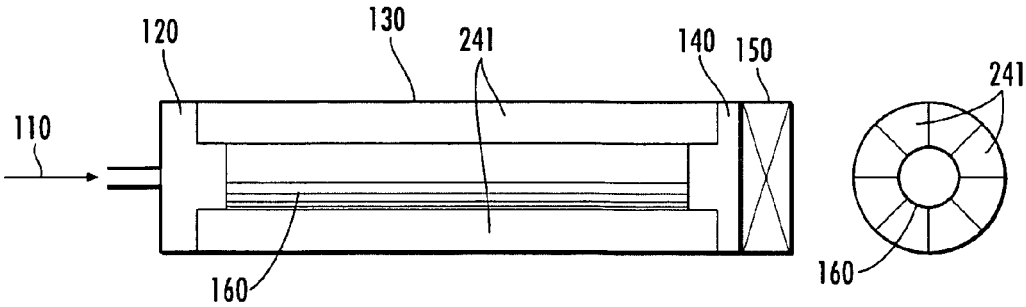
Figure 24:
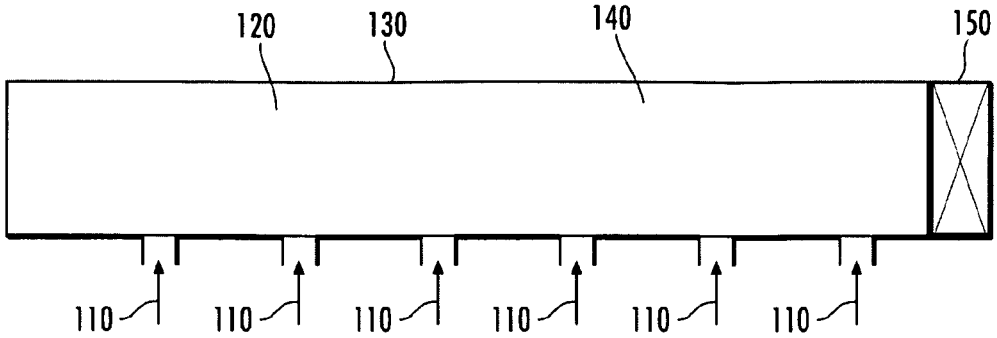
Figure 25:
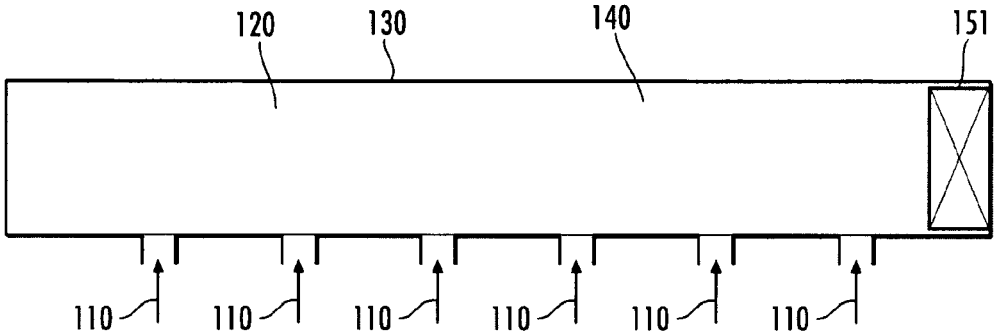
Figure 26:
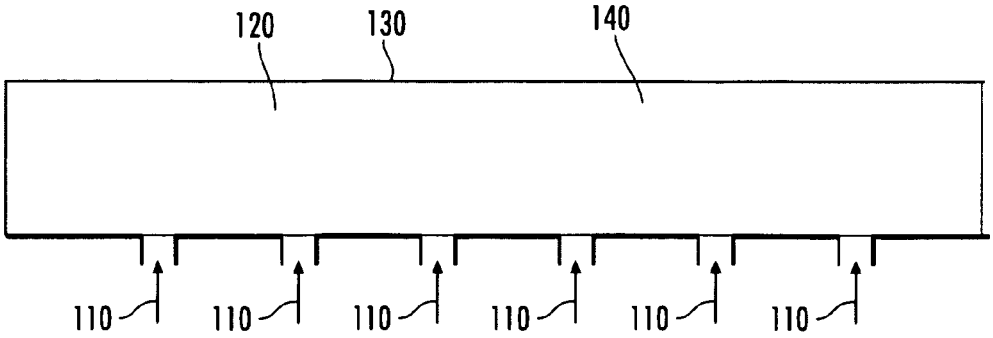
Figure 27:
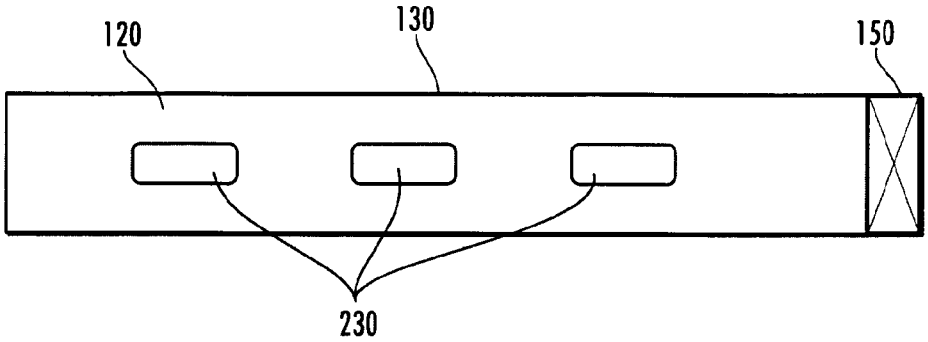
Figure 28:
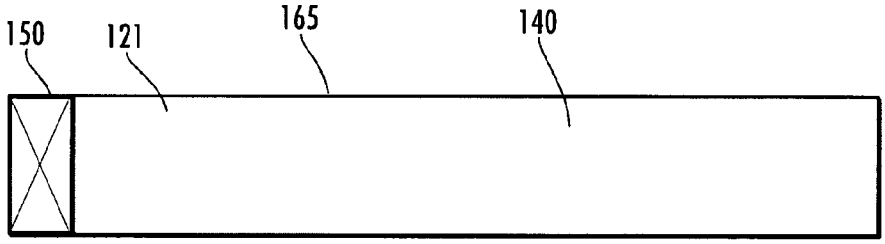
Figure 29:
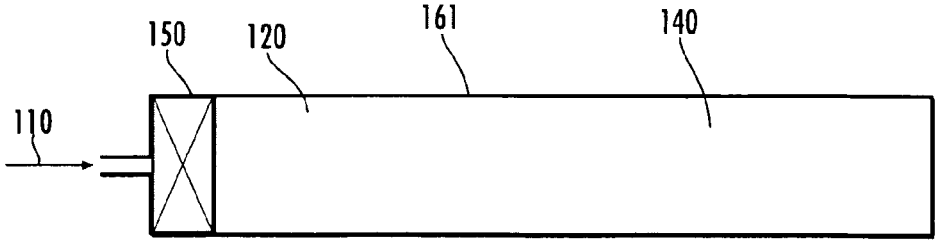
Figure 30:
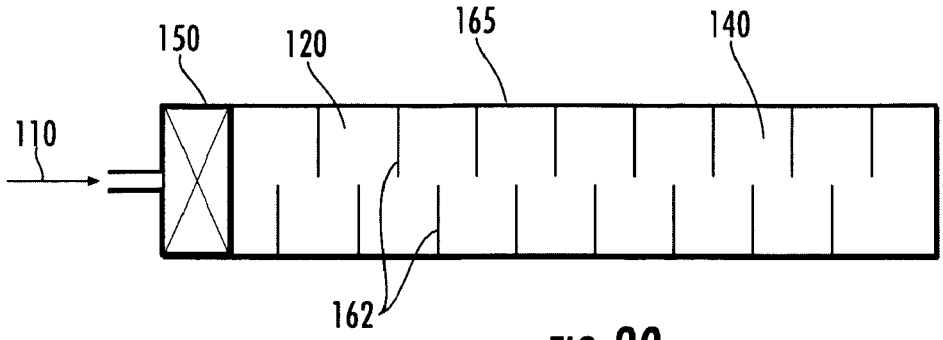
Figure 31:
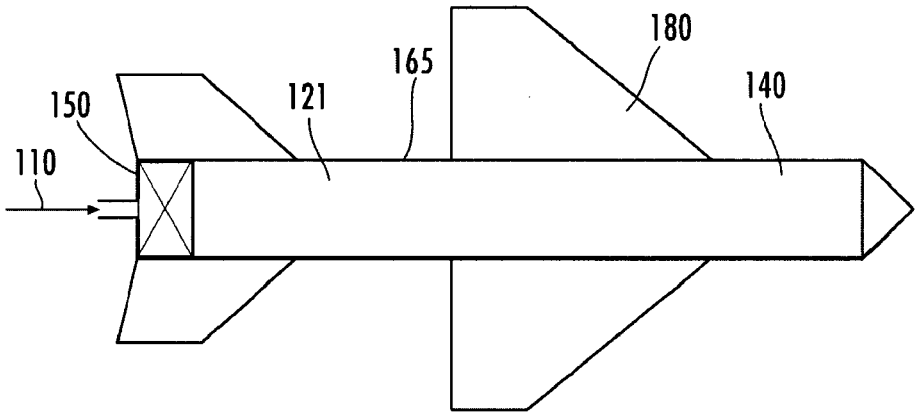
Figure 32:
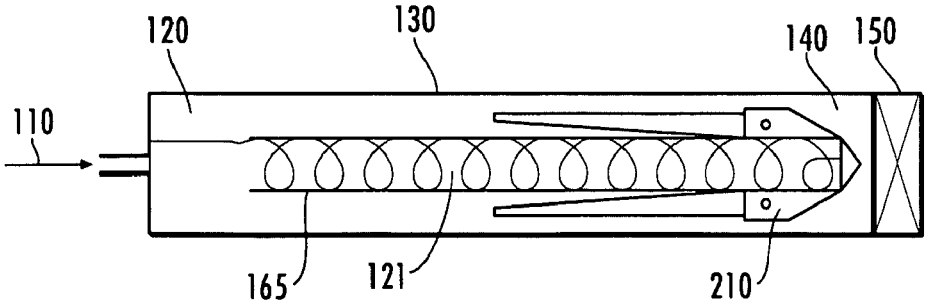
Figure 33:
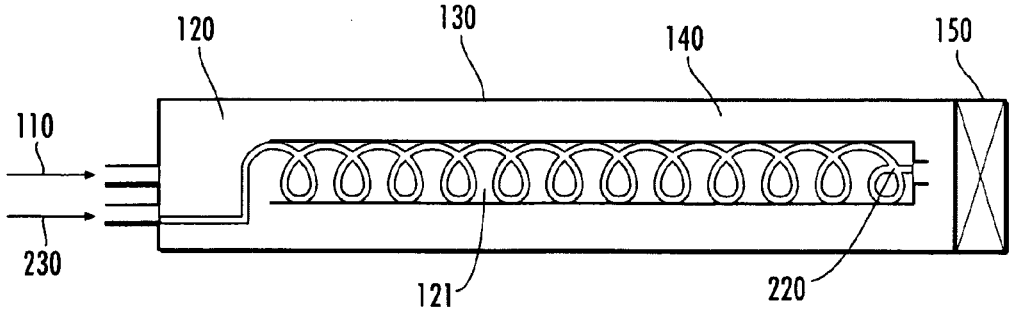
Figure 34:
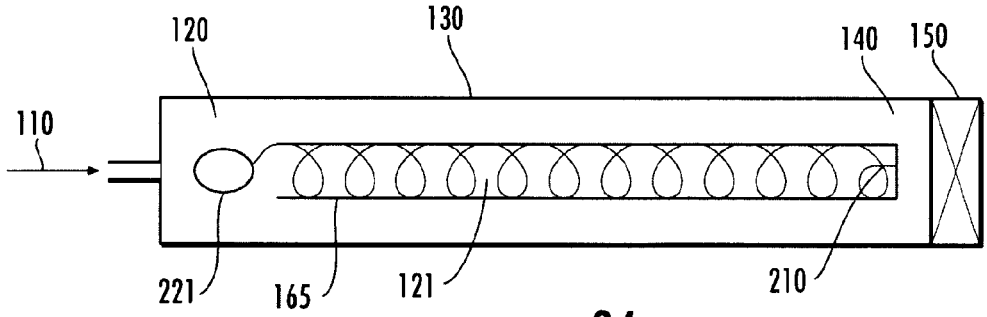
Figure 35:
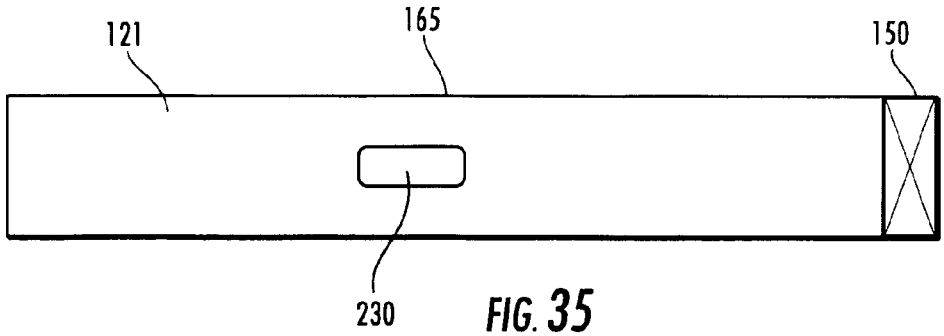
Figure 36:
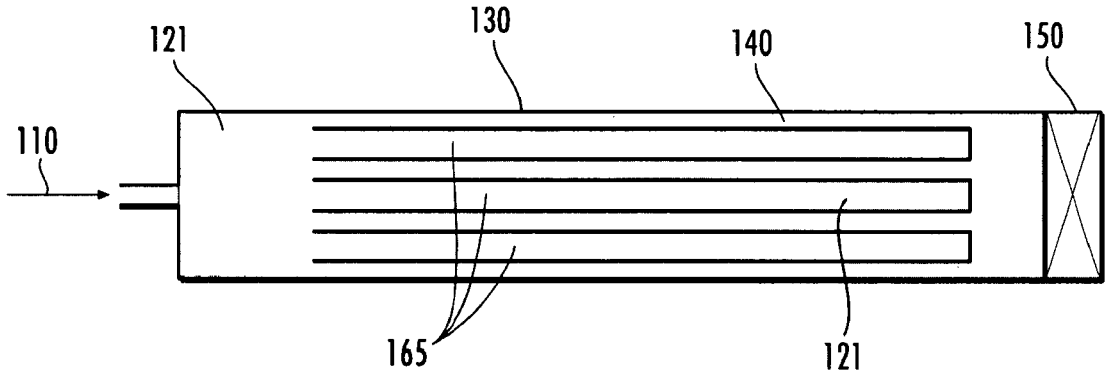

Other embodiments of the projectile propulsion system are illustrated in FIGS. 12-36. These Figures include multiphase material 120, a launch tube 130, compressed gas 140 in porous spaces of the multiphase material, a pressure barrier member 150, and a projectile 160. FIG. 12 illustrates a cross-section of the apparatus for launching projectile(s). FIGS. 12-14 illustrates the system having a gas inlet 110. FIG. 14 illustrates the projectile can be hollow. FIG. 15 illustrates the outer surface of the projectile having ridges to achieve increased surface friction force and range. FIG. 16 illustrates the projectile being located inside an outer body shell that is covered with circular ridges to achieve increased surface friction force and decreased aerodynamic resistance forces during the time of flight. FIG. 17 illustrates the inner surface of launch tube has circular ridges to achieve decreased recoil. FIG. 18 illustrates the launch tube having multiple passive projectiles. FIG. 19-21 illustrate various objects may be attached to the projectiles, such as a net, rope or chain, respectively. FIGS. 22-23 illustrate the projectile being guided inside the launch tube by linear longitudinal ridges or spiral ridges, respectively, along the longitudinal axis of the launch tube. FIGS. 24-26 illustrate the launch tube having several gas inlets to pressurize the launch tube. FIG. 25 illustrates having a pressure barrier member to partially or non-hermetically seal the launch tube. FIG. 26 illustrates the launch tube having no pressure barrier member sealing the launch tube. FIG. 27 illustrates inserting chemicals or chemical charges into the interior of the launch tube to cause chemical reactions within the launch tube. FIGS. 28-31 illustrate the launch tube being active, which means that the launch tube itself becomes a projectile upon activation or breaking of the pressure barrier member. FIG. 29 illustrates a gas inlet located on the pressure barrier member. FIG. 30 illustrates separating plates within the launch tube for preventing motion of the non-cohesive loose granular multiphase material inside the interior of the launch tube under the influence of inertial forces. FIG. 31 illustrates aerodynamic control surfaces on the launch tube's outer surface. FIG. 32 illustrates an active projectile with anchoring foldable or fixed hooks attached to the outer surface of the projectile. FIG. 33 illustrates an active projectile located inside the launch tube, where the active projectile has with a hose inside a chamber of the active projectile. FIG. 34 illustrates a flexible cord or rope being fixed to one end of the active projectile inside the launch tube and a movable weight, charge, an anchor or another payload attached to the other end of the active projectile. FIG. 35 illustrates an active projectile and compressed gas being produced by a chemical charge which is located inside the interior of the active projectile. FIG. 36 illustrates several active projectiles which are located inside a launch tube. It should be understood that other embodiments may also be employed.

The flowcharts and block diagrams in the Figures illustrate the architecture, functionality, and operation of possible implementations of systems and methods according to various embodiments of the present invention. In this regard, each block in the flowchart or block diagrams may represent a module, segment, or portion of code, which comprises one or more executable steps for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein

What is claimed is:

1. A method comprising:

filling an interior cavity of a tube with a multiphase material, wherein the tube comprises sidewalls, a first end, a second end and an opening at the second end;

disposing a projectile into the interior cavity of the tube such that the projectile is surrounded by the multi-phase material;

sealing the opening of the tube with a pressure barrier member while the multi-phase material and projectile are disposed in the interior cavity of the tube;

pressurizing the sealed tube with a gas while the tube is sealed and prior to launching the projectile; and prior to launching the projectile, removing the pressure barrier member thereby allowing equalization of the pressure from the interior cavity with pressure on the exterior of the tube and also thereby resulting in a first shock wave and a second shock wave, the first shock wave emanating away from the projectile and a second shock wave traveling down the tube and reflecting from the first end of the tube so that the projectile is expelled out of the tube.

2. The method of claim 1, wherein the multiphase material comprises sand.

3. The method of claim 1, wherein, in response to the removing the pressure barrier member, the shockwave travels through the multiphase material, thereby breaking up the multiphase material proximate the back wall and causing the multiphase material to be propelled against the projectile so that the projectile is pushed out of the tube.

4. The method of claim 1, wherein the projectile comprises at least one propulsion system, wherein the propulsion system comprises a tube, multiphase material, another projectile and a removable barrier.

5. The method of claim 1, wherein the gas comprises air.

6. The method of claim 1, wherein the launch tube is pressurized to, in one instance, approximately 35,000,000 Pa prior to removing the pressure barrier member.

7. A method of operation of a projectile propulsion system, comprising:

providing a projectile propulsion system comprising a tube comprising an interior cavity and an opening;

disposing multi-phase material in the interior cavity;

disposing a projectile into the interior cavity of the tube such that the projectile is surrounded by the multi-phase material;

sealing the opening of the tube with a removable pressure barrier member while the multi-phase material and projectile are disposed in the interior cavity of the tube;

pressurizing the sealed tube with a gas while the tube is sealed and prior to launching the projectile; and prior to launching the projectile and after pressuring the sealed tube, removing the removable pressure barrier member to allow equalization of pressure from outside of the launch tube and the interior cavity of the launch tube so that when the removable pressure barrier member is removed, the projectile is launched from the tube.

8. The method of claim 7, wherein prior to launching the projectile, removing the barrier thereby equalizing the pressure from the interior cavity with pressure on the exterior of the tube and also thereby resulting in a first shock wave and a second shock wave, the first shock wave emanating away from the projectile and a second shock wave traveling down the tube and reflecting from a back wall of the tube to facilitate pushing and propelling the projectile out of the tube.

9. The method of claim 7, wherein the gas comprises air.

10. The method of claim 7, wherein the multiphase material comprises a multiphase composite structure comprising a multiplicity of elements bonded together.

11. The method of claim 7, wherein the removing the pressure barrier member comprises heating the pressure barrier member.

12. A system of a multiphase projectile propulsion system, comprising:

a tube comprising an interior cavity and an opening;

multi-phase material disposed in the interior cavity of the tube; and a projectile disposed into the interior cavity of the tube such that the projectile is surrounded by the multi-phase material; and a pressure barrier member configured to seal the opening while the multi-phase material and projectile are disposed in the interior cavity of the tube so that the tube can be pressurized with a gas while the tube is sealed and prior to launching the projectile, wherein prior to launching the projectile and after pressuring the sealed tube, the removable pressure barrier member is configured to allow equalization of pressure from outside of the launch tube and the interior cavity of the launch tube when the removable pressure barrier member is removed, thereby launching the projectile.

* * * * *